US011660769B2

(12) United States Patent
Gratsias et al.

(10) Patent No.: US 11,660,769 B2
(45) Date of Patent: May 30, 2023

(54) SHAVING AID DELIVERY SYSTEMS FOR RAZORS

(71) Applicant: Bic Violex S.A., Anoixi (GR)

(72) Inventors: Spiros Gratsias, Athens (GR); Giorgos Georgakis, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 36 days.

(21) Appl. No.: 17/251,900

(22) PCT Filed: Jul. 16, 2019

(86) PCT No.: PCT/EP2019/069163

§ 371 (c)(1),
(2) Date: Dec. 14, 2020

(87) PCT Pub. No.: WO2020/016253

PCT Pub. Date: Jan. 23, 2020

(65) Prior Publication Data

US 2021/0308888 A1 Oct. 7, 2021

(30) Foreign Application Priority Data

Jul. 18, 2018 (EP) ..... 18184277

(51) Int. Cl.
*B26B 21/44* (2006.01)
*B26B 21/22* (2006.01)
*B26B 21/40* (2006.01)

(52) U.S. Cl.
CPC ..... *B26B 21/443* (2013.01); *B26B 21/222* (2013.01); *B26B 21/4062* (2013.01); *B26B 21/4018* (2013.01); *B26B 21/4025* (2013.01)

(58) Field of Classification Search
CPC . B26B 21/443; B26B 21/222; B26B 21/4062; B26B 21/4018; B26B 21/4025; B26B 21/26
See application file for complete search history.

(56) References Cited

U.S. PATENT DOCUMENTS 2,365,486 A * 12/1944 Morris ..... B25B 23/1427 464/37
3,360,856 A * 1/1968 Townsend ..... B26B 21/26 30/346.5

(Continued)

FOREIGN PATENT DOCUMENTS

CN 105219007 B 1/2016
EP 0551407 B1 7/1993

(Continued)

OTHER PUBLICATIONS

International Search Report and Written Opinion in corresponding Application No. PCT/EP2019/069163, dated Oct. 18, 2019, (12 pages).

*Primary Examiner* — Sean M Michalski
*Assistant Examiner* — Liang Dong
(74) *Attorney, Agent, or Firm* — Bookoff McAndrews, PLLC

(57) ABSTRACT

A razor head, comprising a housing comprising one or more cutting elements, the housing further comprising a first window, and a second window; a substrate-based shaving aid delivery system, comprising a first reel that is rotatably mounted about a shaft, an actuator operationally coupled with the shaft, wherein at least part of the actuator protrudes externally from the housing via the first window; and a substrate carrying a shaving aid on its external surface.

20 Claims, 5 Drawing Sheets

(56) References Cited

U.S. PATENT DOCUMENTS

| | | | | |
|---|---|---|---|---|
| 4,562,644 | A | 1/1986 | Hitchens | |
| 5,005,287 | A | 4/1991 | Ritter | |
| 5,713,131 | A | 2/1998 | Rogers et al. | |
| 6,511,507 | B2 | 1/2003 | Shah et al. | |
| 6,532,667 | B1 | 3/2003 | Leaseburge | |
| 8,236,214 | B2 | 8/2012 | Kwiecien | |
| 2005/0108879 | A1* | 5/2005 | Coffin | B26B 21/44 30/41 |
| 2005/0126007 | A1 | 6/2005 | Aviza | |
| 2009/0223057 | A1 | 9/2009 | Epstein et al. | |
| 2013/0042482 | A1 | 2/2013 | Bradford et al. | |
| 2015/0107114 | A1 | 4/2015 | Minsk et al. | |
| 2016/0338928 | A1 | 11/2016 | Haught et al. | |

FOREIGN PATENT DOCUMENTS

| | | | |
|---|---|---|---|
| EP | 1252985 | B1 | 10/2005 |
| EP | 1615751 | B1 | 8/2011 |
| EP | 3030387 | B1 | 5/2019 |
| WO | 2004091870 | A1 | 10/2004 |

* cited by examiner

SHAVING AID DELIVERY SYSTEMS FOR RAZORS

CROSS REFERENCE TO RELATED APPLICATION(S)

This application is a National Stage Application of International Application No. PCT/EP2019/069163, filed on Jul. 16, 2019, now published as WO2020016253 and which claims priority from European Application No. EP18184277.4, filed on Jul. 18, 2018.

TECHNICAL FIELD

The present disclosure is related to shaving aid delivery systems, and more particularly the disclosure is related to razor heads incorporating such shaving aid delivery systems.

PRIOR ART

A razor head typically includes one or more blades mounted within a housing including a guard bar (at the lower end of the cartridge) and a cap at the top of the cartridge. The guard bar and the cap may include various implements such as skin lubricants, beard softeners, hair stretchers, etc., with a goal of improving a shaving experience for a user.

The shaving aids commonly used for shaving are gels, creams or lotions that either cannot be incorporated in a razor head or they require more auxiliary means on a razor head to support their application (e.g. channels, dispensing containers, pumps, rollers). Regarding the shaving aids that can be incorporated in razor heads, it is common to use lubrication strips that are attached to a razor head. Another approach is also the use of shaving aid in film form or as a coating applied unitarily or partially on the razor head.

These existing means for applying shaving aid affect the shaving performance of the razors and in circumstances can reduce the comfort of the shaving experience. The lifecycle of the shaving aids is sometimes not coordinated with the life of the razor blades such that the shaving aid supply is typically exhausted before the razor blades wear out (i.e., become too dull to shave efficiently), or, alternatively, the blades may be dulled before the shaving aid supply is exhausted. In addition, the user may be deprived of the opportunity to use the razor multiple times and to determine whether the lubricating means is sufficient for use or if the razor head should be disposed of.

EP 1615751 discloses a razor cartridge having a shaving aid dispensing system that includes a housing that defines a cavity in which a supply of a shaving aid film is disposed. At least one razor blade is positioned within the housing and has an at least partially exposed cutting edge. The supply of shaving aid film is positioned in the cavity and is used to transfer shaving aid to the user's skin during a shaving operation. An applicator is coupled to the housing adjacent the cutting edge of the razor blade. Means are also incorporated in the cavity to provide a path for drawing the shaving aid film from the supply till the applicator. The shaving aid film deposits via the applicator at least a portion of the shaving aid provided thereon, onto the user's skin when contact is made therewith.

It still remains desirable to extend the user-friendly life of a razor head by providing a system that is compact, simple-to-operate, and easy-to-manufacture.

SUMMARY

Aspects of the disclosure provide for a razor head. The razor head includes a housing comprising one or more cutting elements, a first window and a second window. A substrate-based shaving aid delivery system is provided therein, comprising: a shaft comprising a first reel that is rotatably mounted about a shaft. An actuator operationally coupled with the shaft is also provided, wherein at least part of the actuator protrudes externally from the housing via the first window. Also, a substrate carrying a shaving aid on its external surface is provided, wherein a first end of the substrate is attached to the first reel, a second end of the substrate is attached to a portion of the shaft at a different position than the first reel and a first length of the substrate is wound onto the first reel such that upon rotation of the actuator, rotation of the shaft exerts a pulling force to unwind a corresponding portion of the first length of the substrate from the first reel and to wound it about the shaft, wherein at least part of the portion of the first length of the substrate is externally exposed from the housing via the second window.

In some examples, a second reel coaxial with, and fixedly attached to the shaft is provided, wherein the second end of the substrate is attached to the second reel such that the second reel exerts the pulling force.

The fact that the shaving aid is unwound from one reel at the same time as it is wound about another portion of the shaft or about a second reel leaving a portion of the shaving aid exposed through a window provides the razor head with the ability to deliver additional shaving aid e.g. once a first supply of shaving aid has been depleted.

By providing such razor heads, the shaving performance is improved due to consistent and controllable application of shaving aid. Moreover, embodiments of the disclosure allow for adaptable/customizable lubrication of skin as desired by a user. In other words, the user decides if the available lubrication strip is sufficient and whether to keep the current strip, or change the strip by actuating the actuator to cause a new length of unused shaving aid to be exposed in the second window.

Based on the limited components in the delivery system, simple manufacturing and compact design of razor head is also achieved. The mechanism may be concealed in the back of or at the bottom of a razor head, and only one central rolling device is provided to work as both a take-up and supply component for the shaving aid.

The shaft may include a spacing member arranged about the shaft between the first reel and the portion of the shaft carrying the second end of the substrate, to separate wound lengths of the substrate.

The first reel may include first meshing elements configured to be engaged with meshing elements, such as a stop element or cogs. One of the first reel and the actuator may comprise cogs configured to be engaged with a stop element provided on the other of the first reel and the actuator, wherein the stop element is configured to pass from one cog to the subsequent cog thereby tensioning and controlling motion of the substrate.

In some examples, the second reel may share a periphery with the shaft.

The second window may expose a support of the housing, the support being configured to maintain the substrate in a substantially flat position when the substrate is being externally exposed.

The first window may be positioned at a lower area of the housing and near a guard bar of the razor head.

The second window may be positioned on a cap of the razor head parallel to the shaving plane, so as to cause the substrate to trail the cutting elements when the razor head is in use.

In some examples, the stop element may be a pawl.

In some examples, an interior surface of the substrate may include a plurality of teeth configured to engage meshing portion provided on the first reel.

The razor head may include guiding elements configured to guide and maintain a predetermined tension of the substrate.

In some embodiments, the first reel may be biased towards the actuator via a spring so as to add tension to the substrate.

In some embodiments, the guiding elements may be selected from the group consisting of rollers, fixed bumpers, resilient members or pins.

According to further embodiments of the present disclosure, a razor comprising the razor head substantially as described above and a handle connected to the razor head is provided.

In some embodiments, the handle may be removably attached to the razor head.

It is intended that combinations of the above-described elements and those within the specification may be made, except where otherwise contradictory.

BRIEF DESCRIPTION OF THE DRAWINGS

The accompanying drawings, which are incorporated in and constitute a part of this specification, illustrate non-limiting embodiments of the disclosure and together with the description, serve to explain the principles thereof.

DETAILED DESCRIPTION

Reference will now be made in detail to exemplary embodiments of the disclosure, examples of which are illustrated in the accompanying drawings. Wherever possible, the same reference numbers will be used throughout the drawings to refer to the same or like parts.

Embodiments of the present disclosure provide a razor head with a cost-effective, easy-to-manufacture shaving aid delivery system enabling a user to determine when it has become desirable to expose unused shaving aid material at a window present on the razor head.

Figure 1:
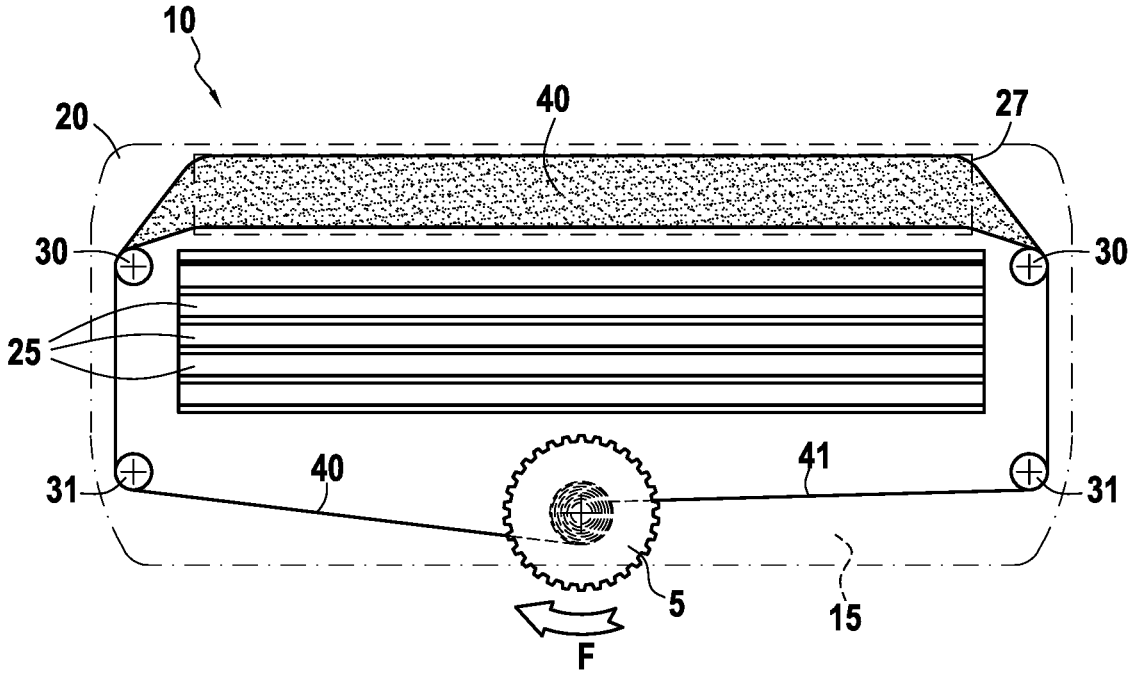
FIG. 1 shows an internal view of a razor head according to embodiments of the present disclosure.
Figure 2:
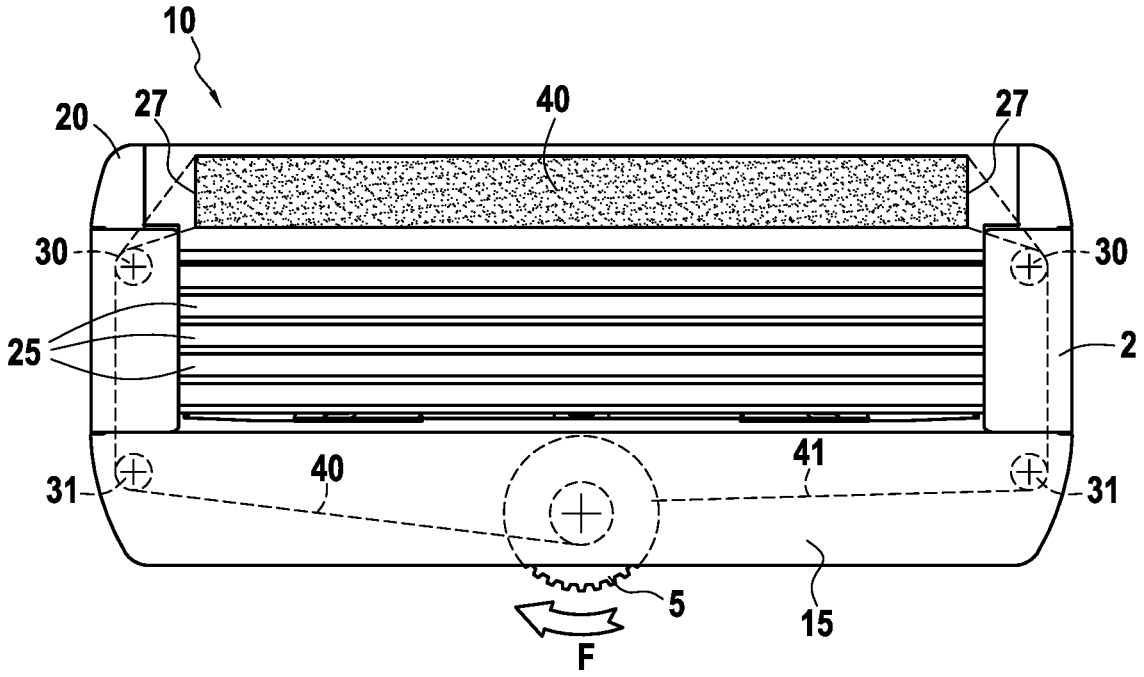
FIG. 2 shows an external view of the razor head shown at FIG. 1.

FIG. 1 shows in schematic an internal view of a razor head 2 according to embodiments of the present disclosure, while FIG. 2 shows an external view of the shaving razor head shown at FIG. 1 with housing 10 intact.

Razor head 2 comprises a housing 10, comprising a cap 20 and a guard bar 15, one or more cutting elements 25, and one or more windows 27, 33, among others.

Housing 10 of razor head 2 and its constituent parts may be fabricated from any suitable material, for example, a plastic, and more particularly a thermoplastic material. For example such materials may include high impact polystyrene (HIPS), Polypropylene (PP), a blend of Polystyrene with Polyphenelyne Oxide, Polyethylene (PE) and/or grades with low, medium or high density of PE (e.g. LDPE, MDPE, HDPE) and more specifically acrylonitrile butadiene styrene (ABS) copolymer.

Housing 10 is configured to house and support various elements associated with embodiments of the present disclosure. For example, housing may contain elements of the shaving aid delivery system of the present disclosure, including one or more tensioners/guiding elements 30, 31, 70, windows 27, 33, reels 22, shaft 14, etc.

In addition, housing 10 may be configured to maintain cutting elements 25 at a predetermined spacing and in a desired position relative to the shaving plane of the razor head 2. For purposes of the present disclosure, the "shaving plane" is defined by a tangent line intersecting the front surfaces of the guard bar 15 of the housing 10 and the cap 20 of the housing 10. A front face of the guard bar 15 and cap 20 is the surface for each one of them that is intended to contact the surface of the user to be shaved, regardless of the presence of intervening elements (e.g., lubricant strips, skin stretchers, etc.). In addition, the term "exposure" as used herein is intended to mean the perpendicular distance from the cutting edge of a cutting element 25 to the shaving plane. For a person skilled in the art the exposure is typically considered positive when the cutting edge is disposed above this tangent line and is considered negative when the cutting edge is positioned below this tangent line, when the razor head is at rest position.

Cutting elements 25 are configured to cut hair present on a surface to be shaved, and may be provided in any suitable number equal or greater than 1. For example, a cutting element 25 may comprise a razor blade, and one or more cutting elements 25 may comprise at least two blades, at least three blades, at least four blades, or even, for example, five blades or more.

Cutting elements 25 may be movably mounted within housing 10 of razor head 2 such that cutting elements 25 may move toward and away from the shaving plane, or cutting elements may be fixed (not movable) within housing 10.

Cutting elements 25 may comprise any suitable material which may be honed or otherwise sharpened to a fine edge suitable for cutting hair, the materials comprising for example, steel and alloys thereof.

Cap 20 and guard bar 15 may be unitarily molded with housing 10, for example by injection molding, and may form portions of housing 10 configured to be at or near a surface of the shaving plane during operation of a razor 1. In addition, cap 20 and guard bar 15 may include various elements known in the art such as, for example, skin stretching features, hair-raising features, etc. Such elements may be affixed to guard bar 15 and/or cap 20 via adhesives or any other suitable method. In addition, guard bar 15 and/or cap 20 may include such elements as heating and/or cooling features, among others.

In some examples, the cap 20 and/or guard bar 15 may include a plateau, or otherwise a support functioning as a plateau configured to assist in maintaining a substrate 40, 41 at a desired location (e.g., parallel to a shaving plane and trailing or leading cutting elements 25). Such plateau being formed, e.g., flat, sloped, as a wedge, etc., on razor head 2 so as to maintain the substrate exposed at the window 27 in a substantially flat position and to a desired location on the razor head 2 when the substrate 40 is being externally exposed. For example, the substrate 40, 41 may be maintained longitudinally parallel to the cutting elements 25 so as to provide a desired shaving experience. Thus, the plateau may be formed of a recess within housing 10 in position parallel to the cutting elements 25 and in a longitudinal direction of the razor head 2. One of skill will recognize that the plateau may be formed by the housing without recess as well, for example, where a thickness of substrate 40, 41 is relatively small (e.g., a single ply).

According to some embodiments, it may be desirable to maintain substrate 40, 41 at a position on the plateau via magnetics. In such embodiments, for example, ferro- or otherwise magnetic particles may be added to a formulation for substrate 40, 41 (such formulations being discussed below), and corresponding magnets placed in and/or on housing 10 at desired locations. Such a configuration may result in additional holding and tension for substrate 40, 41 at a desired location on razor head 2 (e.g., in contact with plateau).

As noted, the housing 10 further contains elements of the substrate-based shaving aid delivery system, this system comprising, a shaft 14, a supply reel 22, a take-up reel, an actuator 5, a supply of substrate with unused shaving aid 40, a substrate of used shaving aid 41, one or more tensioning/guiding elements 30, 31, 70 etc.

Figure 3A:
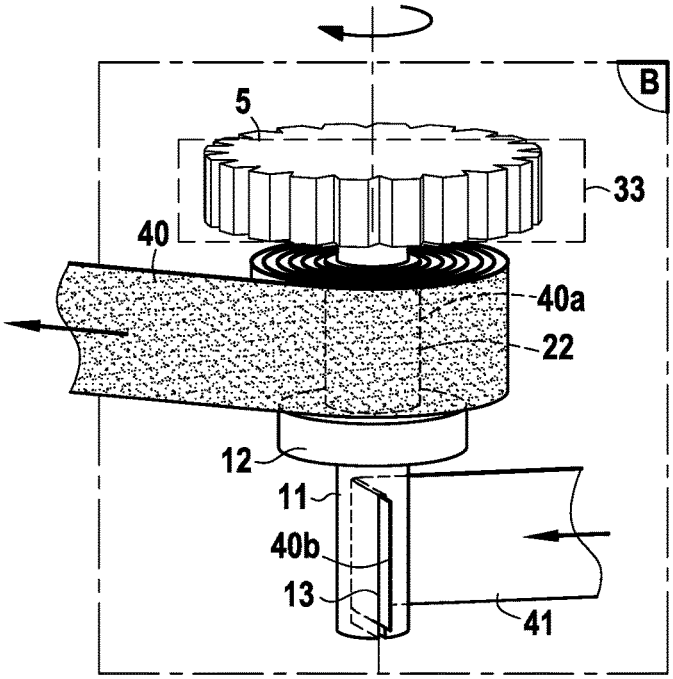
FIG. 3A shows a supply and take-up system of a shaving aid delivery system according to embodiments of the present disclosure.
Figure 3B:
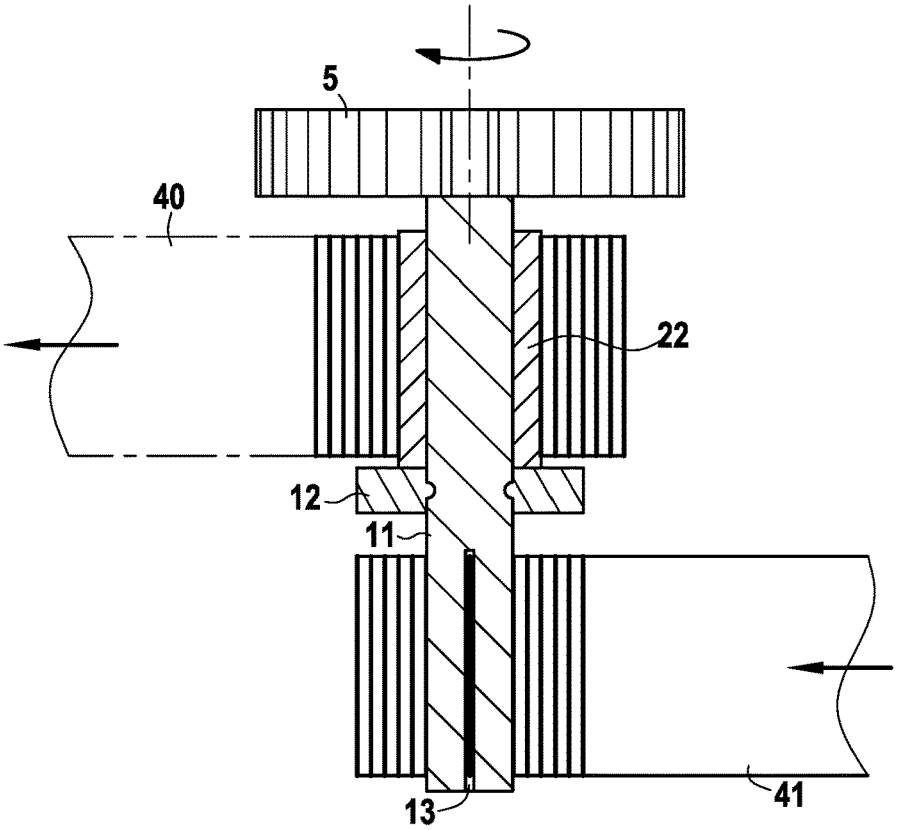
FIG. 3B shows a cross-section viewed along the plane B shown in FIG. 3A.

FIGS. 3A and 3B highlight portions of an exemplary shaving aid delivery system according to embodiments of the present disclosure.

Actuator 5 is configured to enable imparting of motion to substrate 40, 41 on which the shaving aid is dispersed, such motion being imparted via, for example, rotation transmitted to the take-up reel. In some examples, the rotation may be transmitted to a portion 11 of the shaft 14.

Actuator 5 may be concealed on a back portion of a skin adaptor of the razor head 2 and extends, at least in part, through window 33 of housing 10, for example, from a vertical side of the longitudinal wall of the skin adaptor in front of the cutting elements 25, so as to allow a user to turn actuator 5.

Further, window 33 permits exposure of the actuator 5 (e.g., positioned on a bottom or back of the housing 10), or at any location desired based on a desired ergonomic/aesthetic layout for the razor head 2.

Actuator 5 may be fabricated from materials similar to those described with regard to the housing 10, or any other suitable materials, e.g., metals, composites, etc. Actuator 5 may be of any suitable shape, for example, cylindrical, and may be configured to facilitate rotation thereof via manipulation of a user. For example, the actuator 5 may be provided with a knurling about a surface of actuator 5 to facilitate grip for rotation.

Alternatively, the actuator 5 may be configured to be engaged by an electrical servo motor (not shown), which may in turn be configured to electrically cause rotation of actuator 5 by measured intervals.

Supply reel 22 may be cylindrical or otherwise suitably shaped for maintaining a supply of substrate with unused shaving aid 40 thereon. At an initial phase (e.g., before a first use of razor head 2) supply reel 22 may comprises new, unused shaving aid distributed on a single or multi-ply substrate 40, the substrate being wound about supply reel 22 in a desired first direction (e.g., clockwise).

Substrate 40, 41 may be a band- or strip-like material, and may be particularly suited for carrying one or more desired shaving aids on its external portion thereon. Regarding the band-like configuration of the substrate 40, 41, the shaving aid may be applied as a film or a coating developed on the external portion of the substrate 40,41. Regarding the strip-like configuration of the substrate 40, 41, the shaving aid may be directly formed in strip (e.g. extruded strip) with suitable composition for shaving.

For example substrate 40, 41 may comprise Polyvinyl chloride (PVC), ABS, etc., and may be suited for resisting stresses associated with the winding and tensioning desired for maintaining substrate 40, 41 at a desired location during shaving.

According to some embodiments, substrate 40, 41 may comprise a first ply comprising a first material, a second ply comprising a second material, and a third ply/layer comprising the shaving aid. In such embodiments, the first ply may comprise, as noted above, PVC, ABS, or other suitable materials as a conveyor ply (e.g., a ply which may withstand a force associated with winding and unwinding). Positioned on the first ply may then be a carrier ply comprising, for example, polyether bloc amide (PEBA), examples being commercially available under the tradenames PEBAX® or VESTAMID®. On the carrier ply may then be distributed a shaving aid layer, for example, a low-friction hydrophilic coating. In some examples, the carrier ply may comprise a material that may be covalently bonded with the chosen shaving aid. Examples of hydrophilic coatings used as shaving aids to contribute lubricious properties is known in prior-art, such as in U.S. Pat. No. 5,005,287, where it is disclosed that a hydrophilic coating may be a coating comprising a water-soluble polymer or copolymer of poly-N-vinylpyrrolidone. In EP 3 030 387, it is disclosed another example of hydrophilic coating resulted from the polymerization of alternative vinyl monomers with similar suitably high hydrophilic properties that can be grafted onto the carrier ply. Such monomers can be any acrylamide, (e.g. N-Isopropylacrylamide) or a mixture of other monomers copolymerizable with the acrylamide. Other examples of hydrophilic coating used as shaving aid may include lubricious, biocompatible coating compositions structured in one or more layers and comprising essentially a biopolymer, as disclosed in U.S. Pat. No. 6,511,507. The shaving aids applied as coatings may be deposited on the carrier ply, or they can be deposited directly on the conveyor ply. The last scenario is commonly applicable to the cases that the shaving aid is an extruded, thin strip with lubricious composition, which can be attached onto the conveyor ply by any suitable means, for example, gluing, ultrasonically welding, etc or it can directly be incorporated in the shaving aid delivery system acting as substrate. The lubricious composition of such strips can fundamentally comprise a water-soluble component (e.g., polyethylene oxide generally known as POLYOX or ALKOX) and a water-insoluble component (e.g. high impact polystyrene). Examples of water-insoluble components are polystyrene, styrene copolymers, polyethylene, polypropylene, polyacetal, acrylonitrile-butadiene-styrene copolymer, ethylene vinyl acetal copolymer, polylactic acid, polycarbonate, maleic anhydride ethylene co-polymer blends, polyether-containing block copolymers (e.g. with polyamide), blends and copolymers of the above with or without other additives. Typical examples of water-soluble components are polyethylene oxide and/or polyethylene glycol, polyvinyl pyrrolidone, polyacrylamide, polyhydroxymethacrylate, polyvinyl imidazoline, polyvinyl alcohol, polyhydromethymethacrylate, silicone polymers, blends and copolymers of the above. The lubricious composition may additional contain other ingredients selected from the group of plasticizers, such as low molecular weight polyethylene glycols, water-swellable release enhancing agents, such as cross-linked polyacrylics and/or maleic anhydride compounds, additional lubricants, compatibilizers, and/or skin care agents selected in the group consisting of vitamins, botanical extracts, salts, humectants, silicon oils, organic oils, waxes, antioxidants, exfoliants, anti-bacterial agents, anti-microbial, antiseptics, biocides, preservatives, skin soothing agents, hydrating agents, skin protectants, colorants, film formers, processing thickening agents from the list of silica, fume silica, $TiO_2$ particles, and combinations thereof. Several cosmetic ingredients that achieve multiple skin benefits may also be added in the lubricious composition. Alternative lubricious compositions are known and disclosed in patent applications, such as in US20090223057—where as additional ingredients may be included emulsifiers, surfactants, skin conditioners, fragrances, depilatory agents, cleaning agents, medicinal agents; U.S. Pat. No. 8,236,214—where as additional ingredient may be included mineral oil; U.S. Pat. No. 5,713,131, US2016338928—where as additional ingredients may be included cooling agents; US2013042482—where as additional ingredients may be included anti-irritation agents such as a pyrithione or a polyvalent metal salt of pyrithione; CN105219007—where as additional ingredient may be included moisturizing agent selected from olive oil, jojoba oil and glycerin; EP0551407—where as additional ingredients may be included essential oil materials such as menthol, eugenol, eucalyptol, saffrol or methyl salicylate.

Supply reel 22 may comprise any suitable material, for example, a thermoplastic, and may be injection molded or otherwise fabricated from known methods for fabrication of such objects.

Supply reel 22 may comprise a through hole at its center to enable insertion of shaft 14 through supply reel 22. Supply reel 22 may comprise a coating and/or other friction reducing elements (e.g., bearings) at bearing surfaces within the through hole, such that supply reel 22 is permitted to rotate freely about shaft 14 during rotation of the actuator 5.

Shaft 14 provides an axis of rotation about which each of actuator 5, supply reel 22, a take-up reel, and shaft 14 may rotate, in other words, these elements are coaxial, and installed upon shaft 14. The shaft 14 is operationally coupled with the actuator 5.

Shaft 14, as well as constituent parts of the shaving aid delivery system, may be formed of various thermoplastic or other suitable materials. According to some embodiments, shaft 14 may comprise material selected from Polystyrene, High Impact Polystyrene, Polypropylene, Polyethylene, blends of Polyphenylene Oxide with Polystyrene, blends of Polyphenylene Ether with Polystyrene, Polyethylene (PE) and/or grades with low, medium or high density of PE (e.g. LDPE, MDPE, HDPE), Acrylonitrile Butadiene Styrene Copolymer (ABS), among others.

Shaft 14 may be injection molded, or otherwise formed unitarily with actuator 5 and optionally take-up reel, particularly where it is intended that take-up reel to have a similar diameter to shaft 14.

According to some embodiments a slot 13 may be provided within shaft 14 such that the end 40*b* of substrate 40 may be inserted therein allowing shaft 14 to function as take-up reel. Particularly, a first end 40*a* of the substrate 40 is attached to the first reel 22 and the second end 40*b* of the substrate 40 may be attached to a portion 11 of the shaft 14 at a different position/height of the shaft 14 than the first reel 22.

According to some embodiments, the slot 13 may be provided in a distal portion of shaft 14, particularly where take-up reel is to be provided at a distal end of shaft 14. Alternatively, the slot 13 may be provided near a proximal end of shaft 14 (i.e., near actuator 5) where take-up reel is intended to be located close to actuator 5.

The slot 13 may be a through slot or a blind slot in shaft 14 or in take-up reel, where a larger diameter take-up reel is desired. The end 40*b* of the substrate 40 may be retained within the slot 13 for example, via interference fit (e.g., pinching) and/or an elastic deformation of the slot 13. The end 40*b* of the substrate 40 is maintained attached to the take-up reel or to the portion 11 of the shaft 14.

As noted above, a portion 11 of shaft 14, for example, at a distal end thereof, may provide the functionality of take-up reel. Alternatively a distinct take-up reel may be provided, and actuator 5 and take-up reel may be provided with means for engagement such that rotation of actuator 5 is transmitted to take-up reel. For example, the take-up reel may be integrally molded with shaft 14 and actuator 5, in order for the rotation of the actuator 5 to be transmitted to the take-up reel. In some examples, upon rotation of the actuator 5, the consequent rotation of the take-up reel exerts a pulling force to unwind a corresponding portion of the first length of the substrate 40 from the supply reel 22 and to wound it about the take-up reel. In some examples, upon rotation of the actuator 5, the consequent rotation of the shaft 14 exerts a pulling force to unwind a corresponding portion of the first length of the substrate 40 from the supply reel 22 and to wound it about the shaft 14.

Other configurations enabling rotation of take-up reel via rotation of actuator 5 may also be contemplated, and intended to fall within the scope of the appended claims.

In some examples, dimensions of shaft 14, supply reel 22, take-up reel, and actuator 5 may be configured to provide a desired aesthetic appearance of razor head 2, while further providing desired ergonomic functioning of the shaving aid delivery system. According to some embodiments, a diameter of supply reel 22, with a full supply of substrate with unused shaving aid 40 wound thereon may be approximately 3 times greater than an initial diameter of take-up reel, more specifically 4 times greater, and even more specifically 5 times greater.

Window 27 may be present at any suitable location on housing 10, and may comprise voids of material in housing 10, for example, through apertures, permitting passage of the substrate 40, 41 externally from the housing 10. For example, a substrate with unused shaving aid 40 may be pass through aperture of window 27 (e.g., positioned on cap 20 and/or guard bar 15) to rest on a support of housing 10 (e.g. plateau), while another aperture of window 27 may enable passage of the substrate with the used shaving aid 41 back inside housing 10 for winding about the take-up reel.

Window 27 may expose the plateau of the razor head 2, such that the substrate 40 may exit the housing 10 through the window 27 and it may be guided and maintained at a desired location of razor head 2 (e.g. longitudinally parallel to the cutting elements 25).

Window 27 may be sized so as to enable passage of substrate 40, 41 without allowing significant penetration of liquid substances, e.g., water, shaving creams, etc. In addition, various seals may be positioned on window 27 to prevent intrusion of such substances so as to prolong life of the substrate with the unused shaving aid 40.

Additionally, window 33 may further function as a drain location to allow any fluids that may have been introduced inside the housing 10 during shaving, for example, draining from housing 10 once the razor head 2 is placed in an orientation allowing such drainage (e.g. upright on a hanger).

Guiding elements 30, 31, 70, may be configured to direct and transmit the substrate with the unused shaving aid 40 about an internal path, while also maintaining the substrate under tension. Guiding elements 30, 31, 70 may include rollers 30, 31, 280, fixed bumpers 70 (e.g., having a reduced frictional coating), pins and resilient members (e.g., springs) configured to bias the one or more guiding elements so as to aid in maintaining tension of the substrate 40.

Such guiding elements 30, 31, 70 may be mounted in housing 10 around a periphery of the internal path of substrate 40, 41, for example, on pins or mounting points provided on housing 10. In addition, resilient members (not shown) may be provided with each pin/mounting point, so as to enable the biasing in a direction intended to introduce tension to substrate 40, 41.

According to some embodiments, a spacing member 12 corresponding to a stopping mechanism may be provided as a narrow disc-like portion positioned on shaft 14 (concentric therewith) between the supply reel 22 and the take-up reel or the portion 11 of the shaft 14.

The spacing member 12 may be removably arranged about the shaft 14 via, for example, an interference fit, a bayonet fit, snap fit, etc. In some examples the spacing member 12 may be used to keep separate the supply reel 22 from the take-up reel. The spacing member 12 may thereby separate the two reel concentrations, i.e. the concentration of the supply reel carrying a supply of substrate with unused shaving aid 40 and the concentration of the take-up reel carrying a substrate of used shaving aid 41. In some examples, the spacing member may be used to separate wound lengths of the substrate 40 between the first reel 22 and the portion 11 of the shaft 14 that carries the second end 40*b* of the substrate. The spacing member 12 may have a diameter substantially equal to a maximum diameter of the supply reel 22 or the take-up reel when substrate 40, 41 is fully wound about either supply reel 22 or take-up reel.

In addition, a spring 55 concentric with the shaft 14 and the supply reel 22, may be provided above the spacing member 12. Spring 55 may constantly exert a force on the supply reel 22 towards the actuator 5, such that the substrate 40 is pulled in a direction away from the window 27 to create additional tension in the substrate 40, 41. In other words, the first reel 22 is biased towards the actuator 5 via the spring 55 that adds tension to the substrate 40.

Such force may further introduce frictional forces to the supply reel 22 for impeding rotation during shaving, when a rotational force F is not exerted by a user on the actuator 5. According to further embodiments, the spring 55 may also act as meshing element of the supply reel 22 for engagement with the actuator 5, in case that the actuator 5 and the supply reel 22 are deprived of other meshing elements (e.g. cogs).

One of skill in the art will understand that such stopping forces may be overcome by a sufficiently high force F applied to the actuator 5, and that such stopping forces may be set to allow for desired tensioning and ergonomically friendly rotation of actuator 5. For example, a rotation force F used to overcome such stopping forces may range between 3 and 10 N/mm.

Figure 4A:
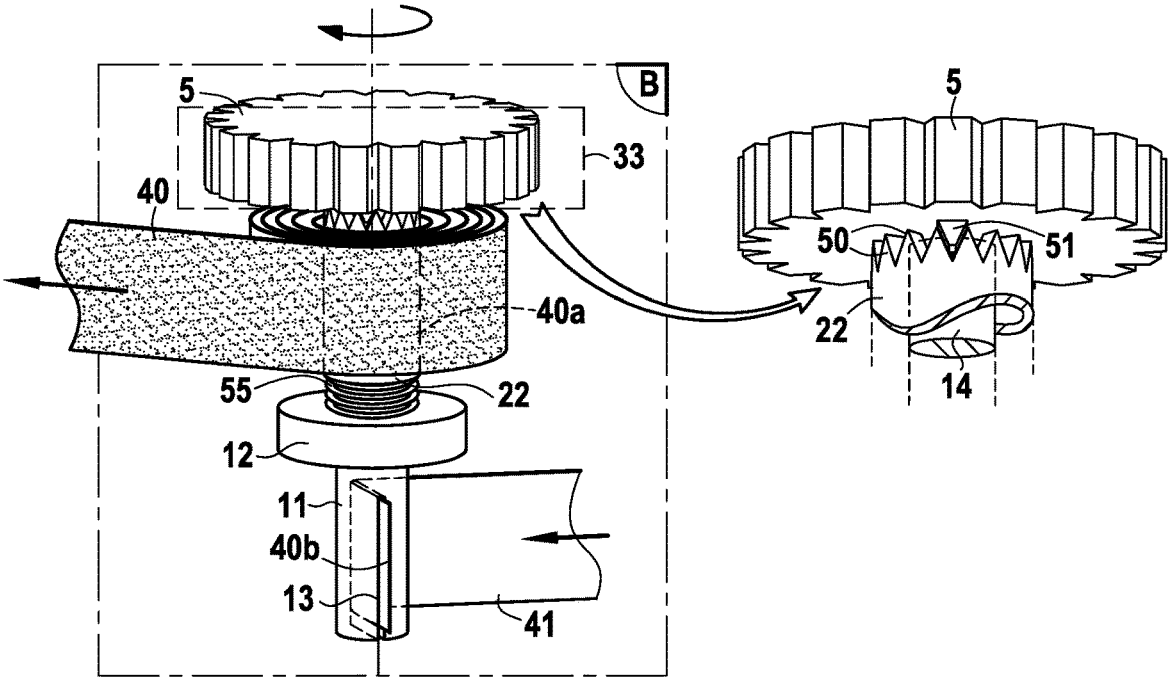
FIG. 4A shows a supply and take-up system of a shaving aid delivery system according to further embodiments of the disclosure.
Figure 4B:
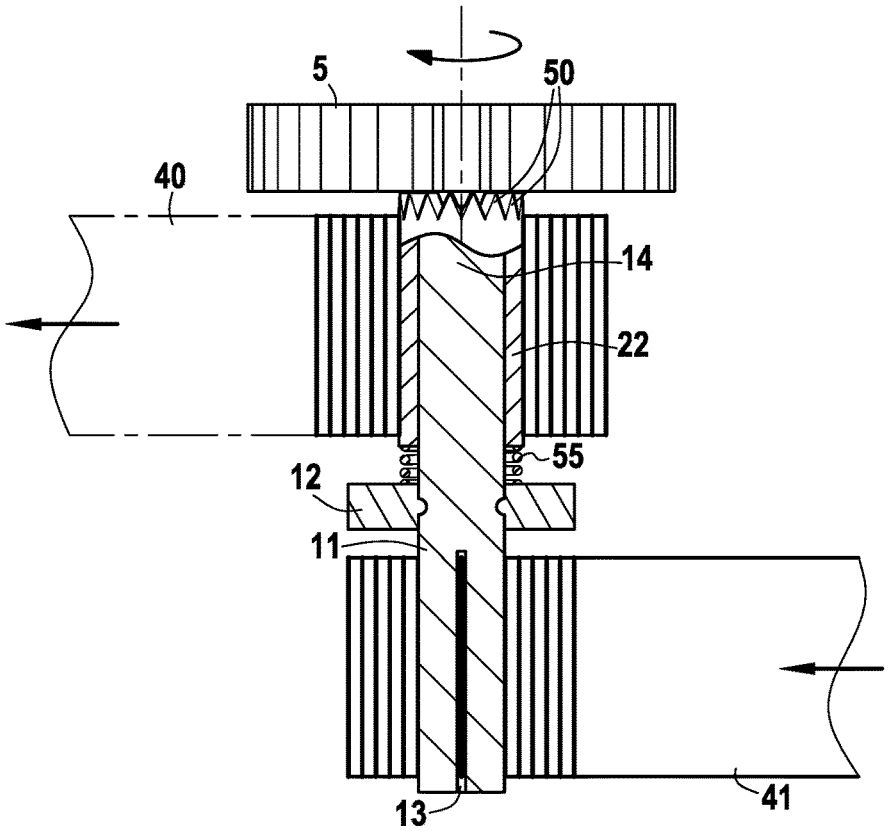
FIG. 4B shows a cross-section viewed along the plane B shown in FIG. 4A.

According to further embodiments, for example, as shown in FIGS. 4A-B, in order to achieve efficient tensioning of the substrate 40, 41, shaft 14, supply reel 22, and take-up reel may be provided with additional features acting as meshing elements, such as cogs or stop elements. In some examples, one of the first reel 22 and the actuator 5 comprises cogs 50 configured to be engaged with a stop element 51 provided on the other of the first reel 22 and the actuator 5, wherein the stop element 51 is configured to pass from one cog 50 to the subsequent cog 50 thereby tensioning and controlling motion of the substrate 40. For example, the supply reel 22 may be provided with cogs on a top surface, such cogs 50 being configured to mesh with a cog 54 or a plurality of cogs 54 present on the actuator 5. Alternatively, a bottom surface of the actuator 5 may comprise a stop element 51 (e.g., a pawl) that may aid in the controllable movement of substrate 40, 41, while tensioning is achieved. In other words, a pawl or other similar element may be provided on the actuator 5 (or even on a portion of the housing 10), the pawl being configured to pass from one cog 50 to the subsequent cog 50 of the supply reel 22, during the rolling, and, for example, providing a haptic feedback (e.g. "click") as each cog 50 is passed, or for example, when winding of a desired length of the substrate occurs (e.g., where spacing of the cogs is set for such a length).

In use, the substrate with the unused shaving aid 40 may be provided from the supply reel 22 and directed to the cap 20 of the razor head via an inner path, e.g., at a lower area of the housing 10 and across a side wall of the housing 10. The substrate 40 passes around tensioners/guiding elements 30, 31, 70, and it is exposed through a first aperture of window 27 (e.g. right side) onto a support of the housing 10 on the cap 20. The cap 20 also includes a second aperture of window 27 on a second side (e.g., left side) to allow the substrate 40, 41 to pass back inside the housing 10, to move around additional tensioners/guiding elements 30, 31, 70 and continue to take-up reel or to the portion 11 of the shaft 14, where the substrate with the used shaving aid 41 is wound for storage.

Linear motion of the substrate 40, 41 along the plateau is achieved when a user rotates the actuator 5 (e.g., counter-clockwise) such that the substrate with used shaving aid 41 is wound around take-up reel or the portion 11 of the shaft 14 (e.g., counter-clockwise), pulling new substrate with unused shaving aid 40 off of the supply reel 22 (e.g., in a clockwise direction).

Because the supply reel 22 is generally freely rotatable about shaft 14 (absent stopping forces described above), and because winding of the substrate with used shaving aid 41 is performed about the take-up reel or the portion 11 of the shaft 14 in a direction opposite to that of the winding of the substrate with unused shaving aid 40 about the supply reel 22, a user may be granted control as to how frequently the substrate with the unused shaving aid 40 is introduced on the support (e.g. plateau) of the window 27 of the razor head 2 via a simplified rotating mechanism, comprising only one axis of rotation.

The substrate 40, 41 is moved through tensioners/guiding elements 30, 31, 70 positioned along the inner path (e.g., in the back of the housing 10) and may be positioned in the right and left side of the housing near a lower area of the housing 10, for example.

Although throughout the figures, the supply reel 22 has been positioned closer to actuator 5 than take-up reel, this may be modified as desired, such that take-up reel is positioned closer to actuator 5, and supply reel positioned near a distal end of shaft 14. Such a configuration may facilitate assembly of the configuration, particularly where it is desired to utilize a take-up reel having a greater diameter than the shaft 14.

FIGS. 6A-6D show another exemplary razor head 2 according to some further embodiments of the present disclosure.

Disposed within the window 23 may be the substrate 40 having an exterior surface 240*a* and an interior surface 240*b*. The substrate 40 may be formed as a ring, or continuous loop. The exterior surface 240*a* may be supplied with a shaving aid. The interior surface 240*b* may have a plurality of teeth 245. The substrate 40 may be positioned in the housing 10 such that the exterior surface 240*a* of the substrate 40 and the shaving aid thereon is at least partially exposed by the first window 23 on the front portion of the housing 10.

The actuator 5 may be disposed at least partially in the window 33. The actuator 5 may be formed to have a gripping portion and meshing elements. The gripping portion may be adapted to be manipulated by a user and may protrude at least partially outside of the second window 33, externally from the housing 10. The meshing portion 263 may be formed to have a plurality of teeth 265 that are configured to engage with the teeth 245 formed on the interior surface of the substrate 40.

The razor head 2 may further include at least one guiding element 280 disposed in the cavity 222 of the housing 10. The guiding element 280 may be configured to keep the substrate 40 taught. The guiding element 280 may be any suitable means that can keep the substrate 40 taught, for example, a spring or spring finger. In particular, the guiding element 280 may be attached to the housing 10 inside of the cavity 222.

Figure 6A:
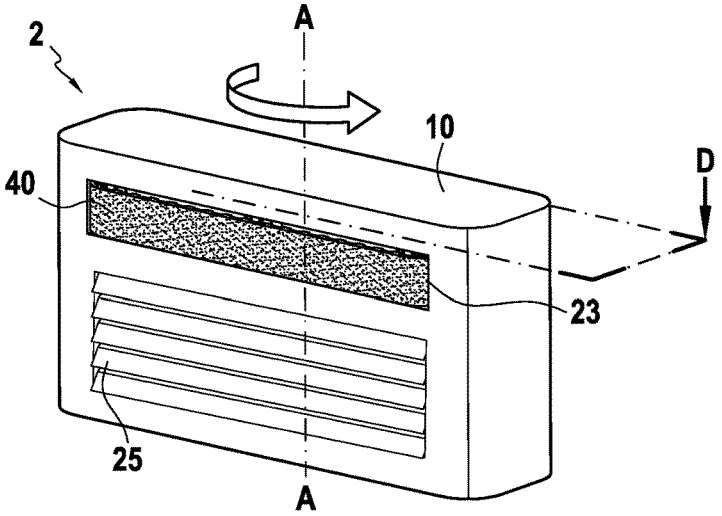
FIGS. 6A-D show an exemplary razor head according to further embodiments of the disclosure
Figure 6B:
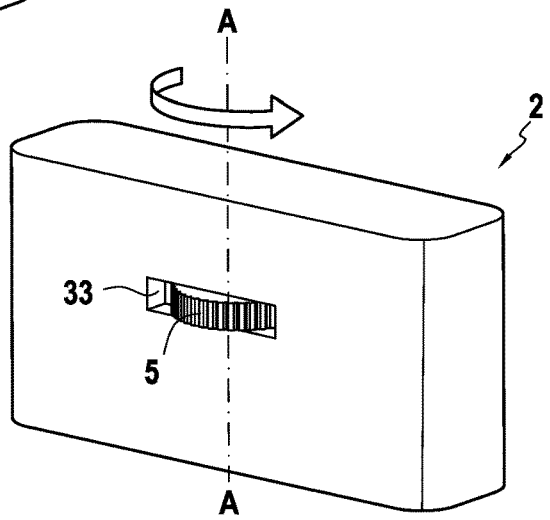
Figure 6C:
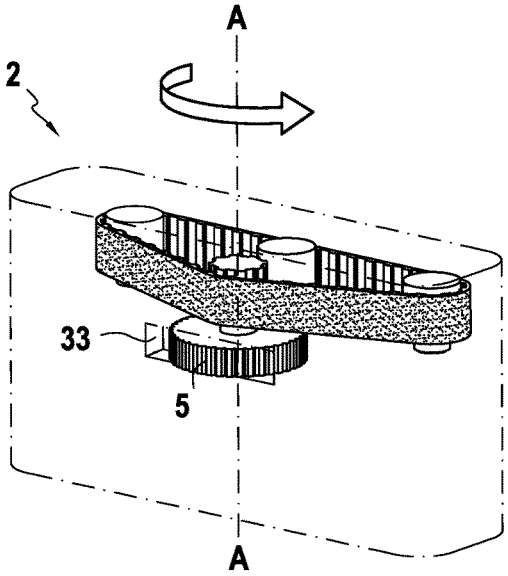
Figure 6D:
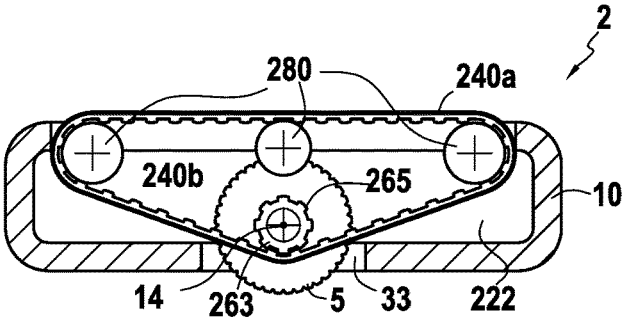

As shown in FIGS. 6C and 6D, the substrate 40 may be supported by three or more guiding elements 280. With this configuration, each of the guiding elements 280 may be adapted to reduce any slack in the ring-shaped substrate 40 by pulling the substrate 40 toward the surface of the housing 10 inside the cavity 222. Although three guiding elements 280 are shown, any appropriate number of tensioners 280 may be used.

In operation, if a user desires to change the portion of the substrate 40 that is exposed by the window 23, the user may apply a rotational force on the actuator 5 about the vertical center axis A-A. As the meshing portion 263 of the actuator 5 rotates, the teeth 265 of the meshing portion are engaged with the teeth 245 of the substrate 40. This meshing and rotation of the actuator 5 causes the substrate 40 to be displaced. As shown in FIGS. 6C and 6D the substrate 40 in the continuous loop-shaped configuration is centrally-moved, i.e. it rotates about the vertical center axis A-A.

Figure 5:
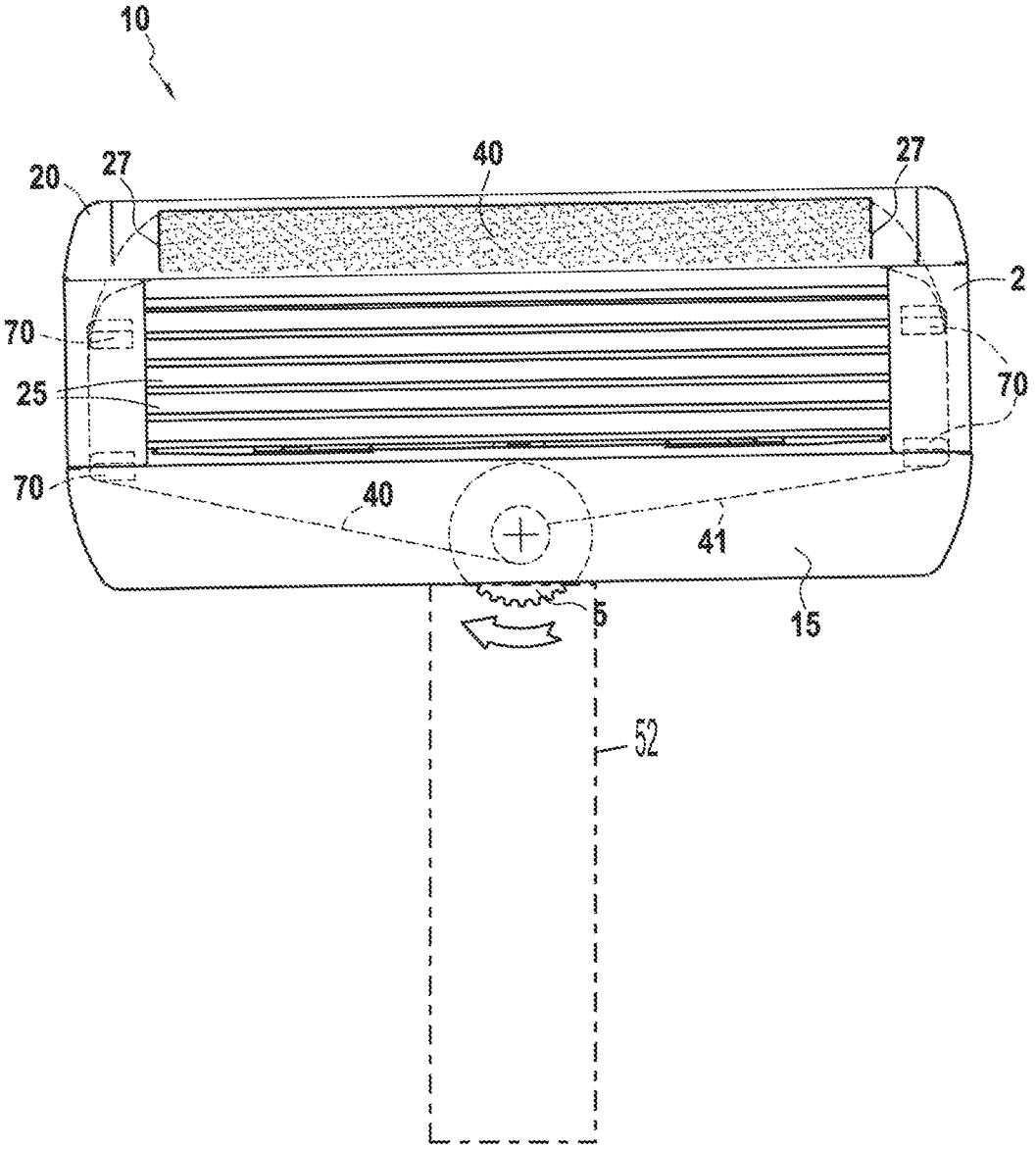
FIG. 5 shows a modified tensioning/guiding system according to embodiments of the present disclosure.

One of skill will understand that other modifications may be made without departing from the scope of the claims. For example, a handle 52 (FIG. 5) may be configured to be attached to the razor head 2 to form a razor. A user may grasp the handle 52 while operating the razor for shaving, and such a handle may be ergonomically designed accordingly. One of skill in the art will recognize that the handle 52 may take any desired shape and form, and may be either removably attached to the razor head 2, or fixedly attached.

Throughout the description, including the claims, the term "comprising a" should be understood as being synonymous with "comprising at least one" unless otherwise stated. In addition, any range in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by a fair reading of the following claims.

The invention claimed is:

1. A razor head, comprising:

a housing comprising one or more cutting elements, the housing further comprising a first window and a second window;

a substrate-based shaving aid delivery system, comprising:

a first reel that is rotatably mounted about a shaft, the shaft having a longitudinal axis that is perpendicular to a shaving plane of the one or more cutting elements, an actuator operationally coupled with the shaft, wherein at least part of the actuator protrudes externally from the housing via the first window; and a substrate carrying a shaving aid on an external surface of the substrate, wherein a first end of the substrate is attached to the first reel, a second end of the substrate is attached to a portion of the shaft at a different position of the shaft than the first reel, and a first length of the substrate is wound onto the first reel such that upon rotation of the actuator rotation of the shaft exerts a pulling force to unwind a corresponding portion of the first length of the substrate from the first reel and to wind the substrate about the shaft, wherein at least part of the portion of the first length of the substrate is externally exposed from the housing via the second window.

2. The razor head according to claim 1, wherein the substrate-based shaving aid delivery system further comprises a second reel coaxial with and fixedly attached to the shaft, wherein the second end of the substrate is attached to the second reel such that the second reel exerts the pulling force.

3. The razor head according to claim 2, wherein the substrate-based shaving aid delivery system further comprises the second reel to share a periphery with the shaft.

4. The razor head according to claim 1, wherein the substrate-based shaving aid delivery system further comprises a spacing member arranged about the shaft between the first reel and the portion of the shaft carrying the second end of the substrate, to separate wound lengths of the substrate.

5. The razor head according to claim 1, wherein the substrate-based shaving aid delivery system further comprises cogs on one of the first reel and the actuator, wherein the cogs are configured to be engaged with a stop element provided on the other of the first reel and the actuator, wherein the stop element is configured to pass from one cog to a subsequent cog thereby tensioning and controlling motion of the substrate.

6. The razor head according to claim 1, wherein the second window exposes a support of the housing, the support being configured to maintain the substrate in a substantially flat position when the substrate is being externally exposed.

7. The razor head according to claim 1, wherein the first window is positioned at a lower area of the housing, the housing further a guard.

8. The razor head according to claim 1, wherein the second window is positioned on a cap of the razor head parallel to a shaving plane, so as to cause the substrate to trail the cutting elements when the razor head is in use.

9. The razor head according to claim 5, wherein the stop element of the substrate-based shaving aid delivery system is a pawl.

10. The razor head according to claim 1, wherein the substrate-based shaving aid delivery system further comprises guiding elements configured to guide and maintain a predetermined tension of the substrate.

11. The razor head according to claim 1, wherein the substrate-based shaving aid delivery system further comprises the first reel to be biased towards the actuator via a spring so as to add tension to the substrate.

12. The razor head according to claim 10, wherein the guiding elements are selected from the group consisting of rollers, fixed bumpers, resilient members, or pins.

13. A razor comprising the razor head according to claim 1 and a handle connected to the razor head.

14. The razor according to claim 13, wherein the handle is removably attached to the razor head.

15. A razor head, comprising:

a housing comprising one or more cutting elements, the housing further comprising a first window and a second window;

a substrate-based shaving aid delivery system, comprising:

a first reel that is rotatably mounted about a shaft, the shaft having a longitudinal axis that is perpendicular to a shaving plane of the one or more cutting elements, an actuator operationally coupled with the shaft, wherein at least part of the actuator protrudes externally from the housing via the first window; and a substrate carrying a shaving aid on an external surface of the substrate, wherein a first end of the substrate is attached to the first reel, a second end of the substrate is attached to a portion of the shaft at a different position of the shaft than the first reel, and a first length of the substrate is wound onto the first reel such that upon rotation of the actuator rotation of the shaft exerts a pulling force to unwind a corresponding portion of the first length of the substrate from the first reel and to wind the substrate about the shaft, wherein at least part of the portion of the first length of the substrate is externally exposed from the housing via the second window, and a spring, wherein the first reel is biased towards the actuator via the spring so as to add tension to the substrate in a direction of the actuator.

16. The razor head of claim 15, wherein the spring is between a spacer and the actuator, and wherein the spacer is adjacent to the spring.

17. The razor head of claim 15, further comprising:

a plurality of guiding elements configured to direct and transmit the substrate around an internal path to direct the substrate such that the shaving aid protrudes from the housing through the first window, facing externally in a direction substantially parallel to the shaving plane, the substrate reenters the housing at the first window, the substrate being configured to travel along the internal path, and wherein the plurality of guiding elements comprise one or more rollers, fixed bumpers, resilient members, or pins.

18. A razor head, comprising:

a housing comprising one or more cutting elements forming a shaving plane, the housing further comprising a first window and a second window;

a substrate-based shaving aid delivery system, comprising:

a first reel and a second reel that are rotatably mounted about a single shaft, the single shaft having a longitudinal axis that is perpendicular to the shaving plane of the one or more cutting elements, an actuator operationally coupled with the shaft, wherein at least part of the actuator protrudes externally from the housing via the second window;

a substrate formed carrying a shaving aid on an external surface of the substrate; and a plurality of guiding elements configured to direct and transmit the substrate around an internal path to direct the substrate such that the shaving aid protrudes from the housing through the first window, facing externally in a direction substantially parallel to the shaving plane.

19. The razor head of claim 18, wherein the substrate reenters the housing at the first window, the substrate being configured to travel along the internal path.

20. The razor head of claim 18, wherein the plurality of guiding elements comprise one or more rollers, fixed bumpers, resilient members, or pins.

* * * * *